US011085452B2

(12) United States Patent
Shimasaki

(10) Patent No.: US 11,085,452 B2
(45) Date of Patent: Aug. 10, 2021

(54) GAS COMPRESSION DEVICE AND METHOD FOR MANUFACTURING THE SAME

(71) Applicant: TOYOTA JIDOSHA KABUSHIKI KAISHA, Toyota (JP)

(72) Inventor: Shinobu Shimasaki, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/397,031

(22) Filed: Apr. 29, 2019

(65) Prior Publication Data

US 2019/0376520 A1 Dec. 12, 2019

(30) Foreign Application Priority Data

Jun. 7, 2018 (JP) ..... JP2018-109313

(51) Int. Cl.

| | |
|---|---|
| ***F04D 13/14*** | (2006.01) |
| ***F04D 13/04*** | (2006.01) |
| ***F04D 29/053*** | (2006.01) |
| ***F04D 29/10*** | (2006.01) |
| ***F04D 13/06*** | (2006.01) |

(52) U.S. Cl.

CPC ..... *F04D 13/14* (2013.01); *F04D 13/04* (2013.01); *F04D 13/06* (2013.01); *F04D 29/053* (2013.01); *F04D 29/102* (2013.01); *F05B 2230/60* (2013.01)

(58) Field of Classification Search

CPC ..... F04D 25/045; F04D 17/10; F02B 37/12

See application file for complete search history.

(56) References Cited

U.S. PATENT DOCUMENTS

| | | | | |
|---|---|---|---|---|
| 3,077,731 | A * | 2/1963 | Addie | F02B 33/00 60/599 |
| 4,125,344 | A | 11/1978 | Tiefenbacher | |
| 5,605,045 | A * | 2/1997 | Halimi | F01D 5/085 310/52 |
| 2007/0280824 | A1 | 12/2007 | Ward | |
| 2012/0039555 | A1 | 2/2012 | Tabata | |
| 2013/0097395 | A1* | 4/2013 | Meyer | G06F 13/4013 711/154 |
| 2015/0118044 | A1 | 4/2015 | Hippen et al. | |

FOREIGN PATENT DOCUMENTS

| | | | | |
|---|---|---|---|---|
| DE | 2527498 | A1 | 12/1976 | |
| JP | 2003202029 | A * | 10/2001 | F04C 27/009 |
| JP | 2009-236068 | A | 10/2009 | |
| JP | 2011-043139 | A | 3/2011 | |
| JP | 2013-050090 | A | 3/2013 | |

* cited by examiner

*Primary Examiner* — Patrick Hamo

(74) *Attorney, Agent, or Firm* — Sughrue Mion, PLLC

(57) ABSTRACT

A gas compression device comprises a first impeller, a rotary shaft on which the first impeller is mounted, and a plurality of rotating members through which the rotary shaft is inserted so that the plurality of rotating members rotate with the rotary shaft. The rotary shaft includes a flange having a first surface perpendicular to an axial direction and projecting in radial directions of the rotary shaft, a rear surface of the first impeller is in contact with the first surface, and the plurality of rotating members are disposed on an opposite side of the flange from the first impeller.

6 Claims, 4 Drawing Sheets

200a
140
92
Air
90a
12
55
74
54
42
53
100a
97
30
52
40
51
71
140
Air
91a
FUEL CELL STACK
Air
120
110
30
Air
94
20
e2
82
Air
140
43
74
75
73
33
34
32
30
98
41
70
71
72
93
24
23
22
11
81
e1
95
X
Z
Y

GAS COMPRESSION DEVICE AND METHOD FOR MANUFACTURING THE SAME

CROSS REFERENCE TO RELATED APPLICATIONS

The present application claims priority to Japanese Patent Application No. 2018-109313, filed on Jun. 7, 2018, the contents of which are incorporated herein by reference in their entirety.

BACKGROUND

Field

The present disclosure relates to a gas compression device and a method for manufacturing the gas compression device.

RELATED ART

JP 2013-50090A describes a device including a rotor shaft and an impeller connected to an end of the rotor shaft as a gas compression device configured to compress gas.

Patent Literature 1: JP 2013-50090A

In the gas compression device, a mounting angle of the impeller relative to the rotor shaft sometimes deviates due to a tolerance or the like of each member mounted on the rotor shaft. If the impeller rotates with such a deviation in the mounting angle, compression efficiency of the gas compression device may decrease.

SUMMARY

According to a first aspect of the present disclosure, a gas compression device is provided. The gas compression device comprises a first impeller, a rotary shaft on which the first impeller is mounted, and a plurality of rotating members through which the rotary shaft is inserted so that the plurality of rotating members rotate with the rotary shaft. The rotary shaft includes a flange having a first surface perpendicular to an axial direction of the rotary shaft and projecting in radial directions of the rotary shaft. A rear surface of the first impeller is in contact with the first surface. The plurality of rotating members are disposed on an opposite side of the flange from the first impeller.

According to a second aspect of the present disclosure, a method for manufacturing a gas compression device is provided. This manufacturing method comprises preparing the first impeller, the rotary shaft including the flange having the first surface perpendicular to the axial direction of the rotary shaft and projecting in the radial directions of the rotary shaft, and the plurality of rotating members configured to rotate with the rotary shaft. The first impeller is mounted on the rotary shaft such that the rear surface of the first impeller is brought into contact with the first surface. The plurality of rotating members are mounted on the rotary shaft on an opposite side of the flange from the side where the first impeller is mounted.

DETAILED DESCRIPTION

A. First Embodiment

Figure 1:
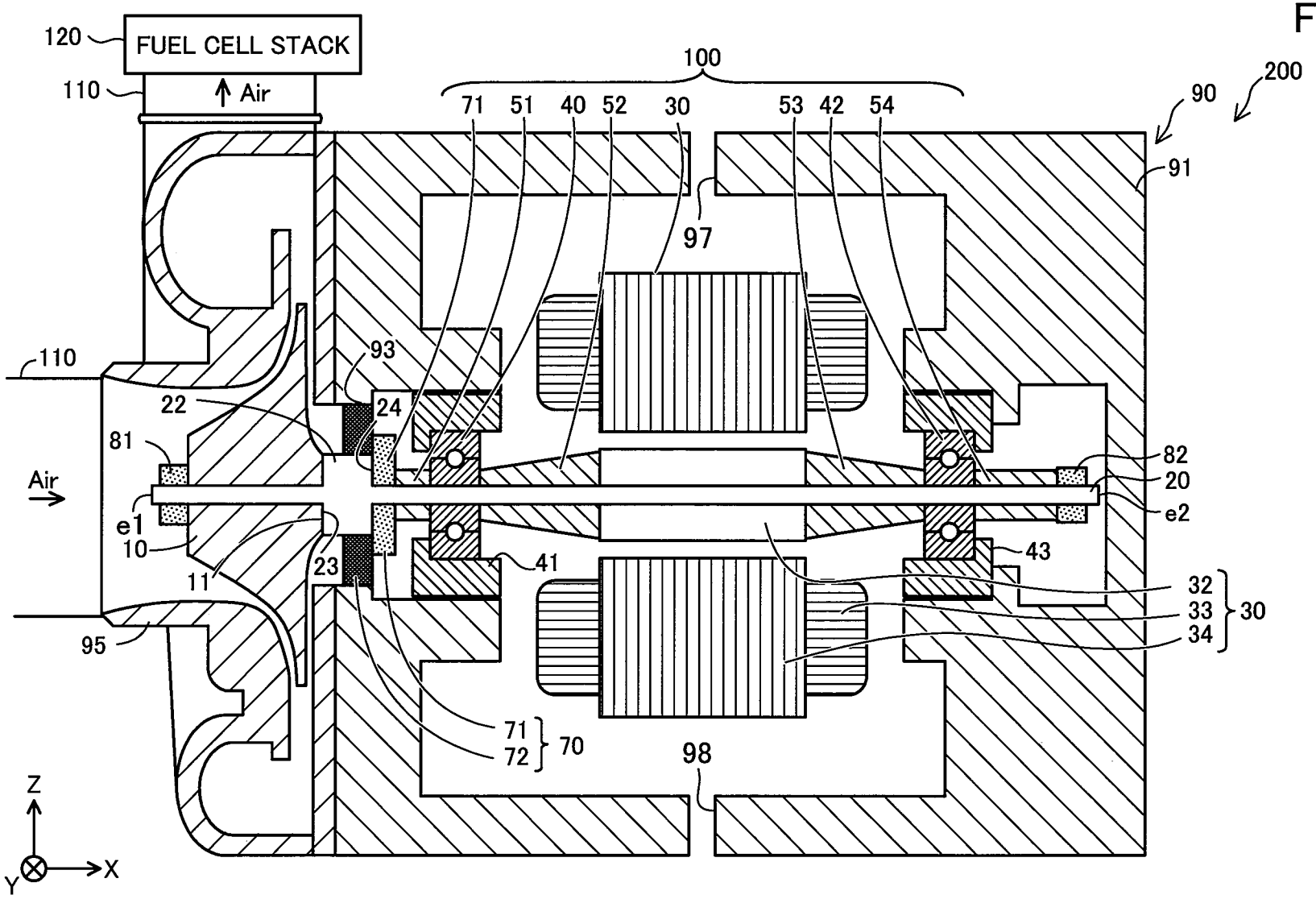
FIG. 1 is a schematic cross-sectional view of a gas compression device according to a first embodiment.

FIG. 1 is a schematic cross-sectional view of a gas compression device 200 according to an embodiment of the present disclosure. The gas compression device 200 is a so-called centrifugal electric compressor. In this embodiment, the gas compression device 200 is disposed on a gas supply flow path 110, through which gas is supplied to a fuel cell stack 120, so as to compress the gas to supply it to the fuel cell stack 120. As for the gas, air is used in this embodiment; however, oxygen and other kinds of gases may be used.

The gas compression device 200 includes a first impeller 10 and a rotary shaft 20. The gas compression device 200 further includes bearings 40 and 42, bearing cases 41 and 43, spacers 51 to 54, a mechanical seal 70 including a rotary ring 71 and a fixed ring 72, nuts 81 and 82, and a housing 90. The housing 90 includes a motor housing section 91 storing a motor 30 and a first-impeller housing section 95 storing the first impeller 10. FIG. 1 illustrates X, Y, and Z axes that are orthogonal to each other for ease of description. The X axial direction corresponds to an axial direction of the rotary shaft 20. The Z axial direction is a perpendicular direction and corresponds to a radial direction of the rotary shaft 20 in FIG. 1. FIG. 1 is provided to easily understand technical features of the gas compression device 200, and it does not show precise sizes of respective members.

The rotary shaft 20 includes a flange 22 that is integrally formed with the rotary shaft 20 such that it projects in the radial directions of the rotary shaft 20. The flange 22 includes a first surface 23 and a second surface 24 that are perpendicular to the axial direction. Being "perpendicular to the axial direction" means a range of 0.3° above or below 90° relative to the axial direction. In this specification, it is preferable that the configurations arranged perpendicular to the axial direction is arranged in the range of 90°±0.1° to the axial direction. The first surface 23 is on a side of a first end e1 of the rotary shaft 20 while the second surface 24 is on a side of a second end e2 of the rotary shaft 20. In other embodiments, the flange 22 does not need to include the second surface 24. For example, part of the flange 22 on the side of the second end e2 may incline relative to the axial direction. In another embodiment, the flange 22 may be molded separately from the rotating shaft 20. In this case, the flange 22 is fixed to the rotating shaft 20 and integrated with the rotating shaft 20.

Part of the rotary shaft 20 on the side of the first surface 23 projects into the first-impeller housing section 95 through a through hole 93 formed in the motor housing section 91. The first impeller 10 is mounted on the rotary shaft 20 on the side of the first surface 23. On the side of the second surface 24, the rotary ring 71, spacer 51, bearing 40, spacer 52, rotor 32, spacer 53, bearing 42, and spacer 54 are mounted on the rotary shaft 20 in this order from the second surface 24. The rotary shaft 20 is inserted into each of these components disposed on the side of the second surface 24, so that each of these components rotates with the rotary shaft 20. Each of these components, which is disposed on the opposite side of the flange 22 from the first impeller 10 and through which the rotary shaft 20 is inserted, is also referred to as a "rotating member 100". Each of the rotating members 100 is in contact with adjoining rotating members 100 in the axial direction. An end of the spacer 54 is in contact with the nut 82. The nut 82 fixes positions of the rotating members 100 in the axial direction.

The first impeller 10 rotates to compress the gas supplied through the gas supply flow path 110 in the first-impeller housing section 95 and send it to the fuel cell stack 120. The first impeller 10 is also referred to as a compressor wheel. As shown in FIG. 1, the rear surface 11 of the first impeller 10 is in contact with the first surface 23 of the flange 22. The first impeller 10 is fixed to the first end e1 of the rotary shaft 20 with the nut 81. The nut 81 fixes a position of the first impeller 10 in the axial direction. Each of the nuts 81 and 82 is also referred to as a "fixture".

The motor 30 is an electric motor to drive the first impeller 10. The motor 30 includes the rotor 32 through which the rotary shaft 20 is inserted and a stator 34 facing the circumference of the rotor 32 and including a coil 33. The rotor 32 is disposed on the side of the second surface 24 of the flange 22. The rotor 32 is provided with a magnet on its surface and integrally rotates with the rotary shaft 20. The stator 34 is supplied with electricity to rotate the rotor 32. The motor 30 is energized by a controller that is not shown in the drawings. The controller controls rotating speed of the motor 30 depending on a generation requirement of the fuel cell stack 120 so as to make the gas compression device 200 generate pressure appropriate to a generation amount from the fuel cell stack 120. In addition, the controller controls an oil pump, not shown, so as to supply oil into the motor housing section 91.

The bearings 40 and 42 rotatably support the rotary shaft 20. As shown in FIG. 1, the bearing 40 is disposed on a side of the first impeller 10 relative to the rotor 32. The bearing 42 is disposed on the opposite side of the rotor 32 from the bearing 40. Each of the bearings 40 and 42 in this embodiment is a ball bearing including a plurality of balls; however, it may be a different kind of bearing such as a needle bearing.

Each of the bearing cases 41 and 43 is formed in a ring shape and respectively stores the bearing 40 or 42 in its ring-shaped inside.

The motor housing section 91 stores the motor 30. In the motor housing section 91, an oil supply flow path 97 and an oil discharge flow path 98 are formed. The oil supply flow path 97 is located perpendicularly above the motor 30. The oil supply flow path 97 supplies oil from an oil cooler, not shown, to the inside of the motor housing section 91. The oil flowing into the motor housing section 91 through the oil supply flow path 97 cools the motor 30. Between the motor housing section 91 and the bearing cases 41 and 43 are formed gaps. The gaps are filled with the oil supplied through the oil supply flow path 97 so as to form oil dampers between the motor housing section 91 and the bearing cases 41 and 43. The oil discharge flow path 98 is located perpendicularly below the motor 30. The oil discharge flow path 98 discharges the oil in the motor housing section 91 to the outside of the motor housing section 91.

The mechanical seal 70 is a seal unit including the fixed ring 72 and the rotary ring 71. The fixed ring 72 is disposed between the bearing 40 and the first impeller 10 and fixed to the motor housing section 91. The rotary ring 71 is in contact with the fixed ring 72. When the rotary shaft 20 rotates, the rotary ring 71 rotates, but the fixed ring 72 does not. Therefore, when the rotary shaft 20 rotates, the fixed ring 72 and the rotary ring 71 slidably contact with each other while keeping a gap in a micron unit between them. This configuration allows for high-speed rotation of the rotary shaft 20 while restraining the oil in the motor housing section 91 from oozing out into the side of the first impeller 10 through the gap between the fixed ring 72 and the rotary ring 71. In addition, the rotary ring 71 is fixed such that it is in contact with the second surface 24 of the flange 22 in this embodiment. Accordingly, a surface of the rotary ring 71 in contact with the second surface 24 of the flange 22 and a surface of the fixed ring 72 in contact with the rotary ring 71 are disposed in parallel with high precision. As a result, the oil in the motor housing section 91 is further restrained from oozing out into the side of the first impeller 10 through the gap between the fixed ring 72 and the rotary ring 71 in this embodiment.

The spacers 51 to 54 adjust positions of the bearings 40 and 42, the rotary ring 71 and the rotor 32 in the axial direction. The spacer 51 is disposed between the rotary ring 71 and the bearing 40 so as to be in contact with them. The spacer 52 is disposed between the bearing 40 and the rotor 32 so as to be in contact with them. The spacer 53 is disposed between the rotor 32 and the bearing 42 so as to be in contact with them. The spacer 54 is disposed between the bearing 42 and the nut 82 so as to be in contact with them. The number and shapes of the spacers may be appropriately modified depending on, for example, the lengths of the rotary shaft 20 and the plurality of rotating members 100 other than the spacers 51 to 54 in the axial direction.

Figure 2:
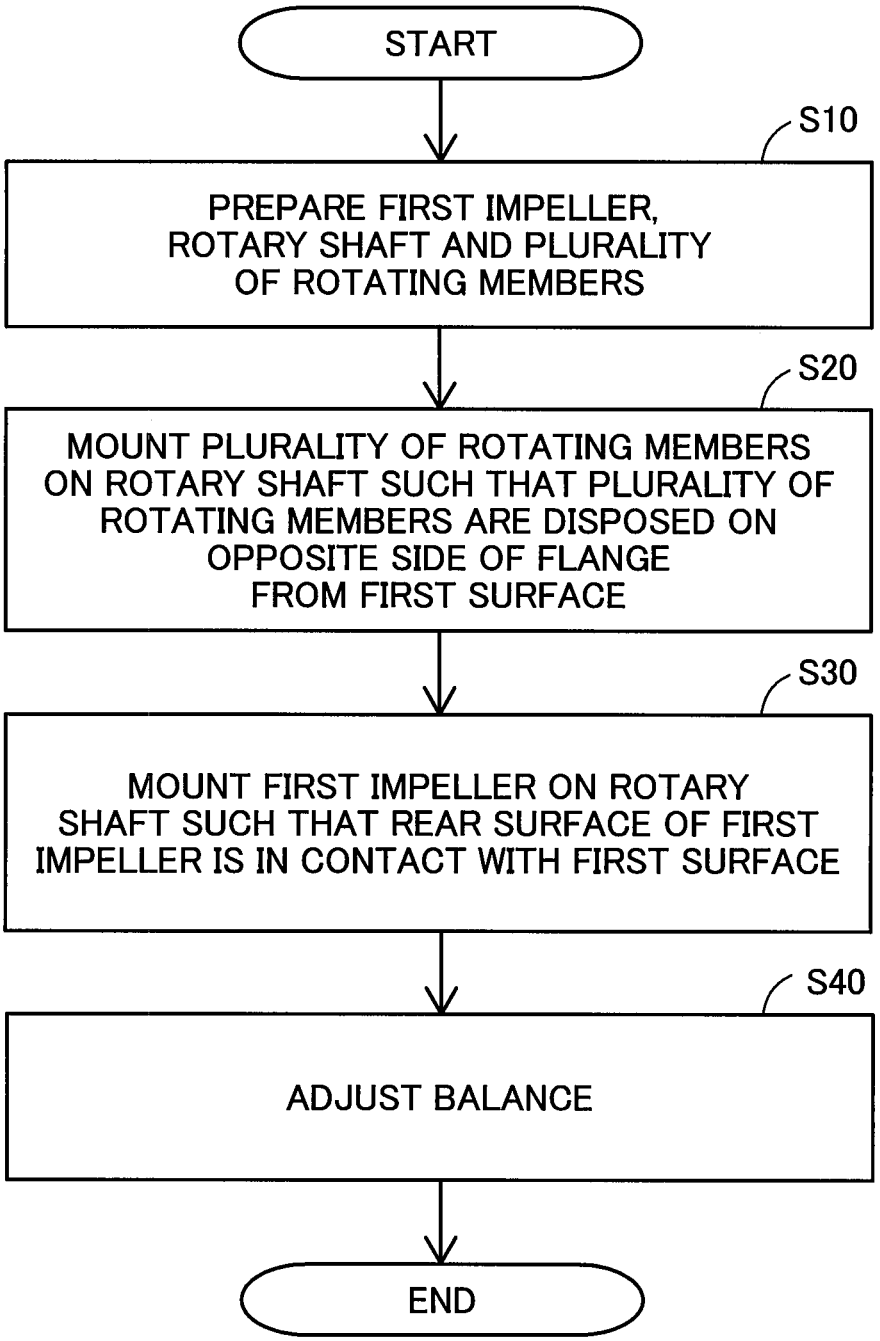
FIG. 2 is a flowchart illustrating a method for manufacturing the gas compression device.

FIG. 2 is a flowchart illustrating a method for manufacturing the gas compression device 200. The method for manufacturing the gas compression device 200 comprises preparing the rotary shaft 20, the first impeller 10 and the plurality of rotating members 100 (step S10).

Next, the plurality of rotating members 100 are mounted on the rotary shaft 20 on the opposite side of the flange 22 from the side where the first impeller 10 is to be mounted (step S20). First of all, the rotary ring 71 is mounted on the rotary shaft 20 such that the rotary ring 71 is in contact with the second surface 24 of the flange 22 in this embodiment. After the rotary ring 71 is mounted, the spacer 51, bearing 40, spacer 52, rotor 32, spacer 53, bearing 42, and spacer 54 are mounted on the rotary shaft 20 in this order. Then, the nut 82 is fastened to the rotary shaft 20 so as to fix the positions of each of the plurality of rotating members 100 in the axial direction such that the adjoining rotating members 100 are in contact with each other. The rotary shaft 20 on which the plurality of rotating members 100 are mounted is disposed in the housing 90 such that the first surface 23 is exposed in the first-impeller housing section 95.

Next, the first impeller 10 is mounted on the rotary shaft 20 such that the rear surface 11 of the first impeller 10 is in contact with the first surface 23 (step S30). In the step S30, the nut 81 is fastened to the rotary shaft 20 such that the nut 81 is in contact with the first impeller 10 so as to bring the rear surface 11 of the first impeller 10 into contact with the first surface 23 and fix it.

After the first impeller 10 and the plurality of rotating members 100 are mounted on the rotary shaft 20, a balance adjustment of a rotating body constituted of the first impeller 10 and the plurality of rotating members 100 is performed (step S40). The balance adjustment is performed to correct an imbalance of a mass distribution in the radial directions of the rotating body relative to the rotation center of the rotating body, that is, the rotation center of the rotary shaft 20. In the balance adjustment, part of the rotating body having an excess mass in the radial directions of the rotating body is cut with a grindstone or the like, for example. Note that the step S40 may be omitted. Consequently, the gas compression device 200 is manufactured as described above.

According to this embodiment, since the rear surface 11 of the first impeller 10 and the first surface 23 of the flange 22 of the rotary shaft 20 are in contact with each other, an angle between the first impeller 10 and the rotary shaft 20 is not affected by angles between the plurality of rotating members 100 and the rotary shaft 20, even if the angles between the plurality of rotating members 100 and the rotary shaft 20 deviates from a right angle due to manufacturing tolerances or the like of the plurality of rotating members 100. As a result, an imbalance of the first impeller 10 during its rotation can be suppressed. Consequently, it is possible to suppress deterioration in compression efficiency of the gas compression device 200 resulting from the rotation of the rotating body in an imbalance state.

According to this embodiment, since the rotary ring 71 of the mechanical seal 70 is fixed in contact with the second surface 24, the surface of the rotary ring 71 in contact with the second surface 24 of the flange 22 and the surface of the fixed ring 72 in contact with the rotary ring 71 are disposed in parallel with high precision. As a result, compared with the case where the rotary ring 71 is not fixed in contact with the second surface 24, fluid movement from the motor housing section 91 to the side of the first impeller 10 can be suppressed.

According to this embodiment, since the imbalance of the first impeller 10 during its rotation can be suppressed, compared with the case with the imbalance, clearance between the first impeller 10 and the first-impeller housing section 95 can be reduced. As a result, the compression efficiency of the gas compression device 200 can be improved. In addition, the gas compression device 200 can be configured small.

B. Second Embodiment

Figure 3:
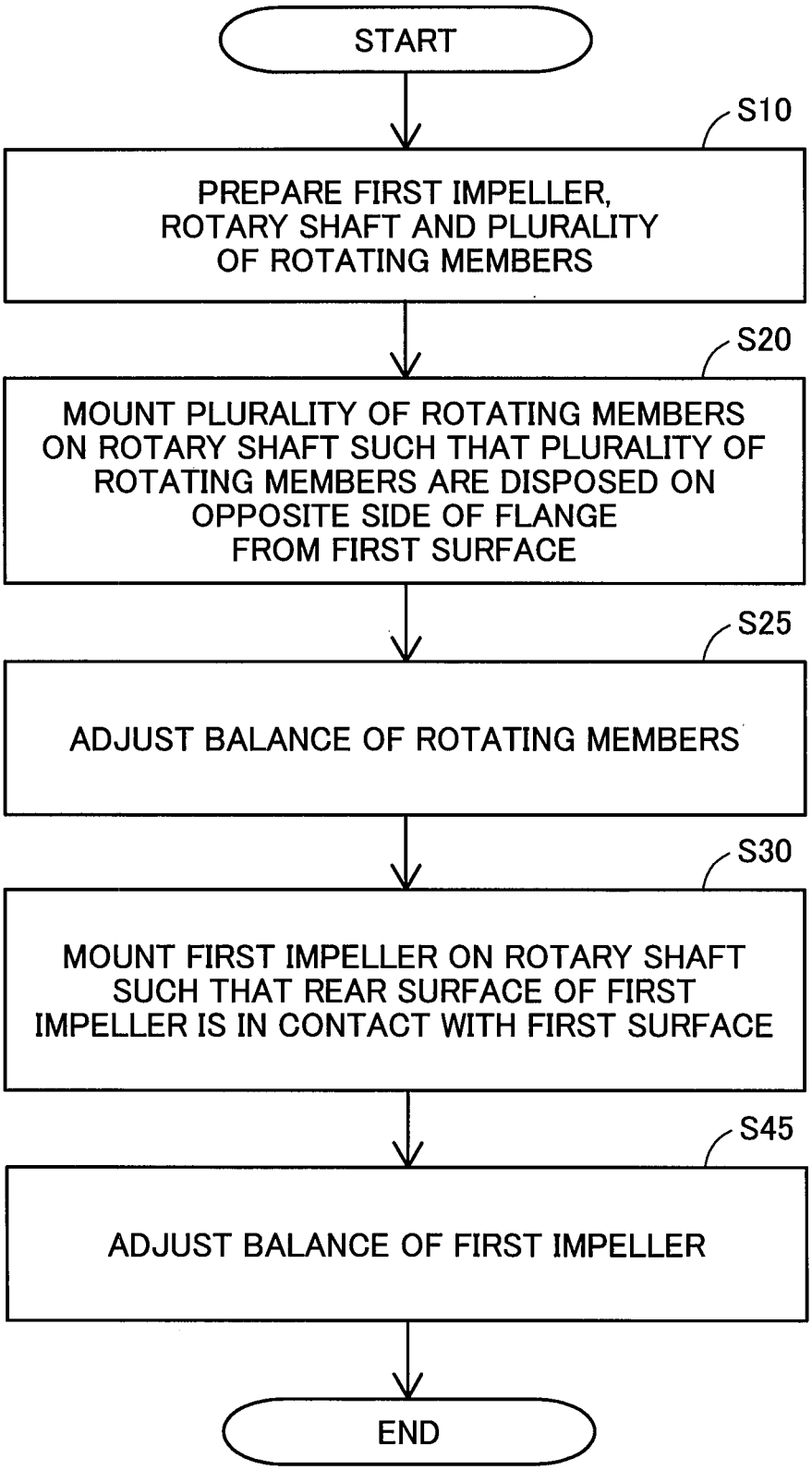
FIG. 3 is a flowchart illustrating a method for manufacturing the gas compression device according to a second embodiment.

In the description below, elements and methods that are the same as those in the first embodiment are denoted with the same reference numerals as those in the first embodiment, and the description thereof will be omitted. The configuration of the gas compression device 200 in the second embodiment is the same as that in the first embodiment, but the method for manufacturing it is different from that in the first embodiment. FIG. 3 is a flowchart illustrating a method for manufacturing a gas compression device 200 according to the second embodiment. In the manufacturing method in FIG. 3, a step S25 is added between the step S20 and the step S30 in FIG. 2 and the step S40 in FIG. 2 is replaced with a step S45.

In the second embodiment, after the plurality of rotating members 100 are mounted on the rotary shaft 20 and the nut 82 is fastened to the rotary shaft 20 (step S20), the balance adjustment of the plurality of rotating members 100 is performed (step S25), before the first impeller 10 is mounted on the rotary shaft 20 (step S30). In the step S25, part of the plurality of rotating members 100 having an excess mass in the radial directions is cut with a grindstone or the like with the plurality of rotating members 100 fixed on the rotary shaft 20.

After the balance adjustment of the plurality of rotating members 100 is performed, the first impeller 10 is mounted on the rotary shaft 20 (step S30), and then, the balance adjustment of the first impeller 10 is performed (step S45). In the step S45, part of the first impeller 10 having an excess mass in the radial directions is cut with a grindstone or the like.

According to this embodiment, the balance adjustment of the plurality of rotating members 100 is performed with the plurality of rotating members 100 fixed to the rotary shaft 20, before the first impeller 10 is mounted on the rotary shaft 20. As a result, since the first impeller 10 is mounted on the rotary shaft 20 with the imbalance of the plurality of rotating members 100 suppressed, the imbalance of the rotating body during the rotation of the first impeller 10 can be suppressed.

According to this embodiment, after the balance adjustment of the plurality of rotating members 100 is performed, the first impeller 10 is mounted on the rotary shaft 20, and then, the balance adjustment of the first impeller 10 is performed. As a result, compared with the case where the balance adjustment is performed on the first impeller 10 and the plurality of rotating members 100 as a whole, the balance adjustment can be readily performed because the range in the axial direction on which the balance adjustment is performed is limited.

C. Third Embodiment

Figure 4:
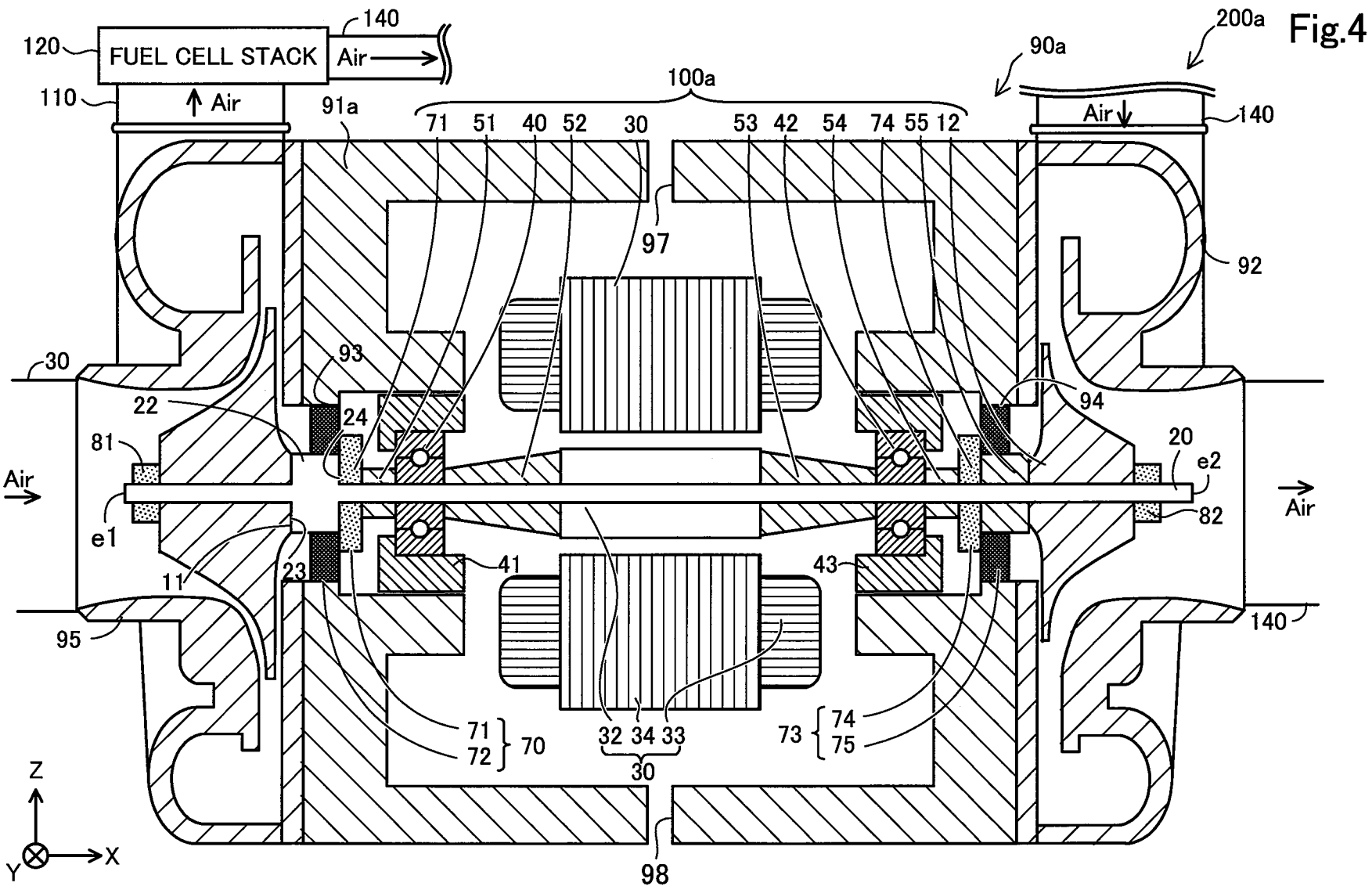
FIG. 4 is a schematic cross-sectional view of a gas compression device according to a third embodiment.

FIG. 4 is a schematic cross-sectional view of a gas compression device 200*a* according to the third embodiment. The gas compression device 200*a* in the third embodiment is different from the gas compression device 200 in the first embodiment mainly in that it includes a second impeller 12 and a housing 90*a* includes a second-impeller housing section 92 that stores the second impeller 12.

The second impeller 12 is fixed to the second end e2 of the rotary shaft 20. The second impeller 12 is rotated by exhaust gas flowing through the gas discharge flow path 140 from the fuel cell stack 120. The second impeller 12 is also referred to as a turbine wheel.

The second end e2 of the rotary shaft 20 projects into the second-impeller housing section 92 through a through hole 94 formed in a motor housing section 91*a*. On the side of the second surface 24 of the rotary shaft 20, the rotary ring 71, the spacer 51, the bearing 40, the spacer 52, the rotor 32, the spacer 53, the bearing 42, the spacer 54, a rotary ring 74, a spacer 55, and the second impeller 12 are mounted in this order from the second surface 24. The rotary shaft 20 is inserted through each of a plurality of these rotating members 100*a* disposed on the opposite side of the flange 22 from the first impeller 10. Each of the rotating members 100*a* is in contact with adjoining rotating members 100*a* in the axial direction. The end of the second impeller 12 is in contact with the nut 82. The nut 82 fixes positions of the rotating members 100*a* in the axial direction.

A mechanical seal 73 is disposed on the opposite side of the rotor 32 from the mechanical seal 70. A fixed ring 75 is disposed between the bearing 42 and the second impeller 12 and fixed to the motor housing section 91*a*. The rotary ring 74 is in contact with the fixed ring 75. When the rotary shaft 20 rotates, the rotary ring 74 rotates, but the fixed ring 75 does not. Therefore, when the rotary shaft 20 rotates, the fixed ring 75 and the rotary ring 74 slidably contact with each other while keeping a gap in a micron unit between the fixed ring 75 and the rotary ring 74. This configuration allows for high-speed rotation of the rotary shaft 20 while restraining the oil in the motor housing section 91*a* from oozing out into the side of the second impeller 12 through the gap between the fixed ring 75 and the rotary ring 74.

The gas compression device 200*a* in the third embodiment can be manufactured by the methods shown in FIGS.

2 and 3. In the step S20, the plurality of rotating members 100*a* are mounted on the rotary shaft 20. First of all, the rotary ring 71 is brought into contact with the second surface 24 and then, the spacer 51, bearing 40, spacer 52, rotor 32, spacer 53, bearing 42, spacer 54, rotary ring 74, spacer 55, and second impeller 12 are mounted in this order. Then, the nut 82 is fastened to the rotary shaft 20 so as to fix the positions of the plurality of rotating members 100*a* in the axial direction such that the adjoining rotating members 100*a* are in contact with each other. The other manufacturing steps are the same as those in the first embodiment or the second embodiment, and the description thereof will be omitted.

According to this embodiment, an imbalance of the first impeller 10 during its rotation can be suppressed in the gas compression device 200*a* including the second impeller 12 rotated by the exhaust gas.

D. Alternative Embodiments (1) The gas compression devices 200 and 200*a* may be oil-free gas compression devices that do not use oil. In this case, each of the gas compression devices 200 and 200*a* does not need to include the mechanical seals 70 and 73, and the second surface 24 may be in contact with, for example, the spacer 51, instead of the rotary ring 71.

(2) In the forgoing embodiments, each of the gas compression devices 200 and 200*a* is disposed on the gas supply flow path 110 through which gas is supplied to the fuel cell stack 120. However, the gas compression device 200 or 200*a* may be disposed on a gas supply flow path through which gas is supplied to a different kind of external device such as an engine so as to compress the gas to supply it to the external device. The second impeller 12 in the gas compression device 200*a* may be driven by gas flowing through a gas discharge flow path that discharges gas from the external device.

(3) In the forgoing first and third embodiments, the order of the step of mounting the first impeller 10 on the rotary shaft 20 (FIG. 2, step S20) and the step of mounting the plurality of rotating members 100 or 100*a* on the rotary shaft 20 (FIG. 2, step S30) may be switched. Since the rear surface 11 of the first impeller 10 and the first surface 23 of the flange 22 of the rotary shaft 20 are in contact with each other, the angle between the first impeller 10 and the rotary shaft 20 is not affected by the angles between the plurality of rotating members 100 or 100*a* and the rotary shaft 20 even if the angles between the plurality of rotating members 100 or 100*a* and the rotary shaft 20 deviates from the right angle due to manufacturing tolerances or the like of the plurality of rotating members 100 or 100*a*, in this embodiment as well. As a result, an imbalance of the first impeller 10 during its rotation can be suppressed. Consequently, it is possible to suppress deterioration in compression efficiency of the gas compression device 200 or 200*a* resulting from the rotation of the rotating body in an imbalance state.

The present disclosure is not limited to the embodiments described above, and may be implemented in various configurations without departing from the gist of the present disclosure. For example, the technical features of the embodiments may be replaced or combined as appropriate, in order to solve part or all of the problems described above or in order to achieve part or all of the advantageous effects described above. The components in the above-described embodiments and modifications other than those described in the independent claims are additional elements that may be omitted as appropriate.

What is claimed is:

1. A gas compression device comprising:

a first impeller;

a rotary shaft on which the first impeller is mounted;

a plurality of rotating members through which the rotary shaft is inserted so that the plurality of rotating members rotate with the rotary shaft, a rotor being one of the plurality of rotating members; and a mechanical seal configured to suppress fluid movement from a motor housing section to a side of the first impeller, the mechanical seal including a fixed ring fixed to the motor housing section and a rotary ring being one of the plurality of rotating members and disposed in contact with the fixed ring in an axial direction, wherein the rotary shaft includes a flange having a first surface perpendicular to the axial direction of the rotary shaft and projecting in radial directions of the rotary shaft, wherein a rear surface of the first impeller is in contact with the first surface, the plurality of rotating members being disposed on an opposite side of the flange from the first impeller, wherein a bearing is disposed between the rotary ring and the rotor, and wherein a first spacer is disposed between the rotary ring and the bearing, and a second spacer is disposed between the bearing and the rotor.

2. The gas compression device according to claim 1, wherein the flange is integrally formed with the rotary shaft.

3. The gas compression device according to claim 1, wherein the rotor is disposed in a motor configured to drive the first impeller, wherein the flange includes a second surface perpendicular to the axial direction, wherein the rotary ring is fixed in contact with the second surface of the flange, and wherein the motor housing section stores the motor without storing the first impeller.

4. The gas compression device according to claim 1, wherein further, one of the plurality of rotating members is a second impeller to be rotated by exhaust gas from an external device, and wherein the rotary shaft includes a first end and a second end, the first impeller being fixed to the first end, the second impeller being fixed to the second end.

5. A method for manufacturing a gas compression device, the method comprising:

preparing:

a first impeller, a rotary shaft including a flange having a first surface perpendicular to an axial direction of the rotary shaft and projecting in radial directions of the rotary shaft, a plurality of rotating members configured to rotate with the rotary shaft, a rotor being one of the plurality of rotating members, and a mechanical seal configured to suppress fluid movement from a motor housing section to a side of the first impeller, the mechanical seal including a fixed ring fixed to the motor housing section and a rotary ring being one of the plurality of rotating members and disposed in contact with the fixed ring in the axial direction;

mounting the rotary ring on the rotary shaft;

mounting the first impeller on the rotary shaft such that a rear surface of the first impeller is brought into contact with the first surface; and mounting the plurality of rotating members on the rotary shaft on an opposite side of the flange from the side where the first impeller is to be mounted, wherein upon assembly, the fixed ring is in contact with the rotary ring, wherein a bearing is disposed between the rotary ring and the rotor, and wherein a first spacer is disposed between the rotary ring and the bearing, and a second spacer is disposed between the bearing and the rotor.

6. The method for manufacturing the gas compression device according to claim 5, wherein the step of mounting the plurality of rotating members on the rotary shaft includes fixing positions of the plurality of rotating members that is mounted on the rotary shaft, in the axial direction, by fastening a fixture on the rotary shaft, and the method further comprising performing balance adjustment of the plurality of rotating members whose positions in the axial direction are fixed, after the step of mounting the plurality of rotating members on the rotary shaft, before the step of mounting the first impeller on the rotary shaft.

* * * * *